US006741440B2

(12) United States Patent
O'Brien

(10) Patent No.: US 6,741,440 B2
(45) Date of Patent: May 25, 2004

(54) MECHANICALLY PULSED MAGNETIZATION KIT

(76) Inventor: Robert Neville O'Brien, 2614 Queenswood Drive, Victoria, BC (CA), V8N 1X5

( * ) Notice: Subject to any disclaimer, the term of this patent is extended or adjusted under 35 U.S.C. 154(b) by 75 days.

(21) Appl. No.: 09/793,557

(22) Filed: Feb. 27, 2001

(65) Prior Publication Data

US 2002/0017894 A1 Feb. 14, 2002

Related U.S. Application Data

(60) Provisional application No. 60/187,772, filed on Mar. 8, 2000, and provisional application No. 60/230,452, filed on Sep. 6, 2000.

(51) Int. Cl.[7] ..... H01H 47/00

(52) U.S. Cl. ..... 361/143; 361/147; 429/10; 320/135; 148/103

(58) Field of Search ..... 361/139, 143, 361/146, 147, 149; 429/10, 12, 19, 49; 320/108, 135, FOR 103; 148/100, 101, 103, 108, 300, 312; 29/602.1, 419.2, 821; 335/284

(56) References Cited

U.S. PATENT DOCUMENTS

| | | | | |
|---|---|---|---|---|
| 3,409,471 A | * | 11/1968 | Sturm et al. | 429/10 |
| 4,000,004 A | * | 12/1976 | Takahashi et al. | 429/10 |
| 4,816,965 A | * | 3/1989 | Drits | 361/267 |
| 4,873,605 A | * | 10/1989 | Drits et al. | 361/143 |
| 6,144,544 A | * | 11/2000 | Milov et al. | 361/143 |

* cited by examiner

*Primary Examiner*—Ronald W. Leja

(57) ABSTRACT

A magnetization method and apparatus is described as utilizing a pair of mechanically counter-vibrated permanent magnets having mutually facing unlike magnetic poles, and wherein a ferromagnetic article, or article containing ferromagnetic elements in close-set array, is placed for subjection to pulsed magnetizing flux between the pair of counter-vibrated magnets. Uses of the invention include making magnets and modifying the current drain property of a multi-plate nickel-metal hydride battery.

3 Claims, 4 Drawing Sheets

MECHANICALLY PULSED MAGNETIZATION KIT

CROSS-REFERENCES TO RELATED APPLICATIONS

Benefit is claimed respecting provisional application No. 60/187,772 filed Mar. 8, 2000, and No. 60/230,452 filed Sep. 6, 2000. Both provisional applications are related to the present invention by virtue of describing means for mechanically pulsed magnetization of ferromagnetic parts, utilizing permanent magnets to supply magnetizing flux.

BACKGROUND OF THE INVENTION

1. Field of the Invention

The field of the invention is that of utilizing permanent magnets to magnetize a ferromagnetic article, more particularly where the magnetization method and apparatus involves permanent magnets that are moved several times in succession alternately toward and away from the ferromagnetic article intended to be magnetized.

2. Background Art

What may be termed an intermittent, interrupted, or, in other words: pulsed mode of magnetization which can utilize, as one option, a permanent magnet in motion, is disclosed in MECHANISM FOR PROVIDING PULSED MAGNETIC FIELD invented by Vladimir Drits, U.S. Pat. No. 4,816,965 issued Mar. 28, 1989. Successively applying, interrupting application of, and then re-applying a magnetic field a desired number of times to a ferro-magnetic article, for example, a cutting tool, is used in accordance with the DRITS patent to cause a reduction or equalization of internal stresses which an article so treated has previously acquired during its service life. Concerning relative motion effected by simple mechanical devices, the cited patent apparently maintains that the same results are produced whether the movement is of the treated article into and from a region containing a magnetic field, or else that the movement involved can just as well be motion of a permanent magnet moved to and from locations from which the external magnetic field about the magnet affects the treated article. A further motional option described involves movement of magnetic shielding material interposed intermittently between a source of magnetic field and the treated article.

A magnetic flux lines configuration shown in DRITS patent drawing figures indicates non-production of unlike magnetic poles on two directly opposite principal faces of the magnetized article, which is a vital intention given effect to by the present invention.

Interrupted magnetization applied to an electrochemical cell is taught in U.S. Pat. No. 3,409,471 issued Nov. 5, 1968 for a METHOD OF PRODUCING ELECTRICAL ENERGY USING MAGNETIC FIELD invented by Ferdinand V. Sturm and Gerhard Richter. An "intermittent or interrupted magnetization" is said to enhance cell operation "in a comparable manner as when a stirred medium is employed." Two figures show arrays of spaced-apart magnets in linear motion parallel to the principal planes of electrodes, and one figure shows an electromagnet that is replaceable by a rotating permanent magnet. No magnetic flux lines configuration is shown in the STURM ET AL patent drawing figures, nor does the text indicate what arrangement, albeit temporary, of poles on magnetically influenced material is intended. Teachings of in situ magnetization of components of a pre-manufactured battery, and of repeating an in situ magnetization process enacted on the battery as needed, are disclosed in U.S. Pat. No. 4,000,004 issued Dec. 28, 1976 for an ELECTRODE FOR ALKALINE STORAGE BATTERY AND METHOD FOR MANUFACTURE THEREOF invented by Sachio Takahashi and Yoshizo Miyake. Again there is no indication of where magnetic poles would occur.

The three cited patents are relevant in the background of the present invention, but information gained therefrom, together with general knowledge in the field, is not believed to support reasonable expectation of success at attaining the surprising results of the present invention.

BRIEF SUMMARY OF THE INVENTION

The embodied invention is an outgrowth of successive discoveries made in a course of research using two counter-vibrated, ie., mutually to-and-fro moving, assemblies of neodymium-iron-boron magnets mounted with unlike poles facing one another across a gap therebetween to the two counter-vibrated arms of a mechanical device. The gap width varies rapidly between a maximum at which external magnetic fields about the two magnet assemblies are substantially independent with little or no flux in the gap, and a minimum gap width at which strong magnetizing flux contributed to by both assemblies extends across the gap.

Discovered while developing the strip magnetization apparatus disclosed in provisional application No. 60/187,772 is the fact that vibrating the magnetizing magnets assemblies alternately together and apart induces a stronger magnetization of a ferromagnetic strip in the gap between the two assemblies than if the same strip were between them with them held stationary.

Subsequently it became apparent that parallel ferromagnetic strips or sheets separated by a thin layer of non-magnetic material such as paper could be magnetized at the same time., in the same fashion of subjection to intermittent strong flux between the vibrating magnet assemblies as with an individual sheet. Thereafter, there was one further step to take, to see what result would obtain by magnetizing, by the same method, the closely spaced ferromagnetic planar electrodes of a pre-manufactured commercial example of a nickel-metal hydride battery.

Incorporated herein by reference is the matter in provisional application No. 60/230,452 of an amazing finding that when a battery with vertical planar ferromagnetic electrodes, not initially magnetized, is placed between the same pair of counter-vibrated magnetizing assemblies as used for making sheet magnets, the current drain property of the battery will afterwards be found to have been affected alternatively in either an increasing or else decreasing manner, depending on end-for-end orientation of the battery in the gap between the magnetizing assemblies. This result is totally unknown in the relevant prior art literature.

The embodied invention may be summarized to be a product or kit which groups together two mechanically counter-vibrated permanent magnet assemblies having magnetic poles of unlike sign which intermittently mutually face one another across the narrowest width of the variable-width gap therebetween, with one or more ferromagnetic articles having two opposite principal faces each, where the principle faces are of substantially congruent shape with the inward-facing faces of the two mechanically counter-vibrated permanent magnet assemblies. Whatever the ultimate account may be regarding precisely how and why all results of practicing the invention occur, the invention is susceptible to uses which go well beyond, without excluding, the original proposal to magnetize a strip of ferromagnetic material in a gap made alternately narrower and wider between counter-vibrated magnets.

BRIEF DESCRIPTION OF THE FIGURES OF DRAWING

Figure 6:
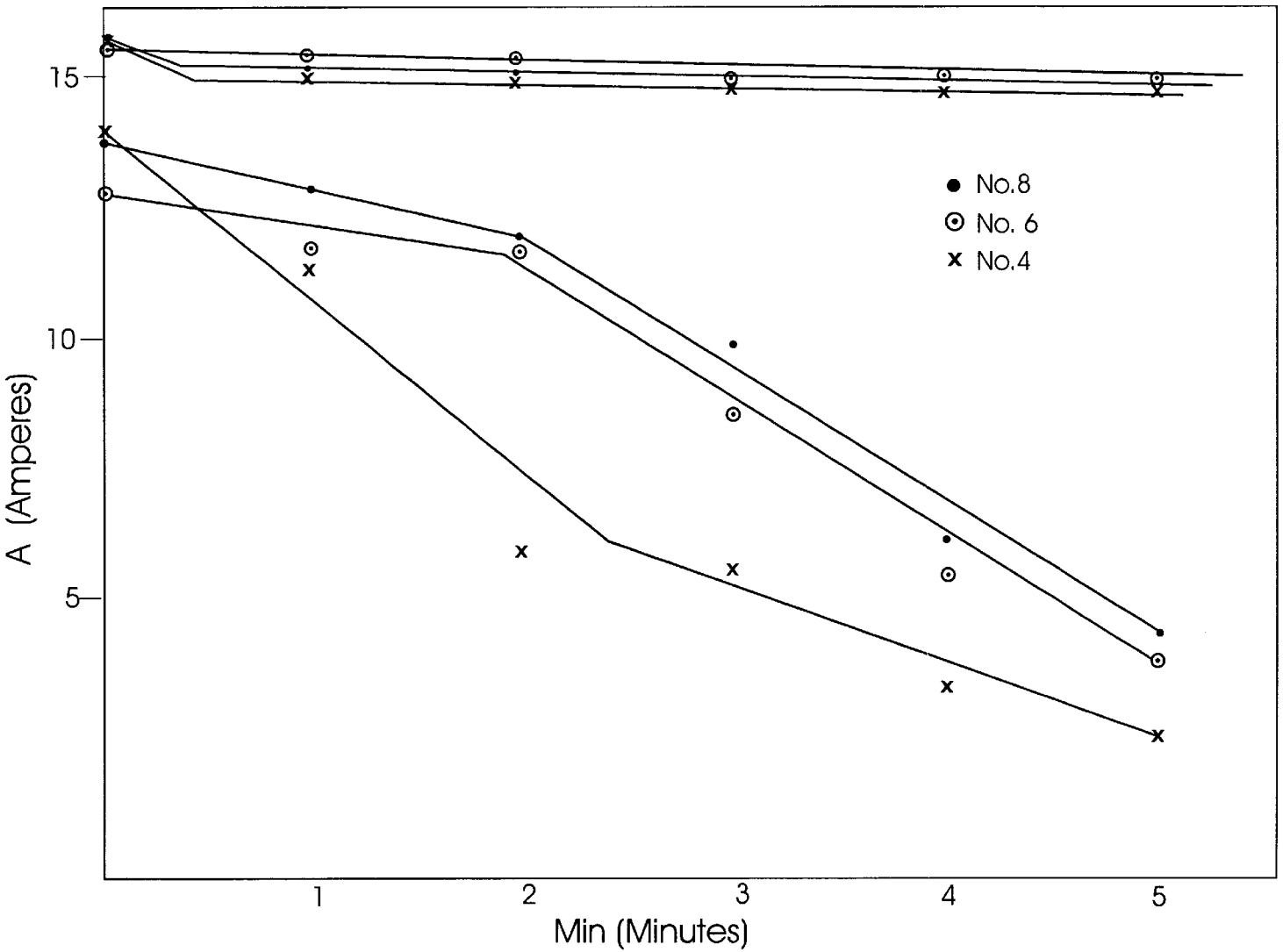

FIG. 6 graphs results of practicing the invention in conjunction with a multi-plate nickel-metal hydride battery.

DETAILED DESCRIPTION OF THE INVENTION

Figure 1:
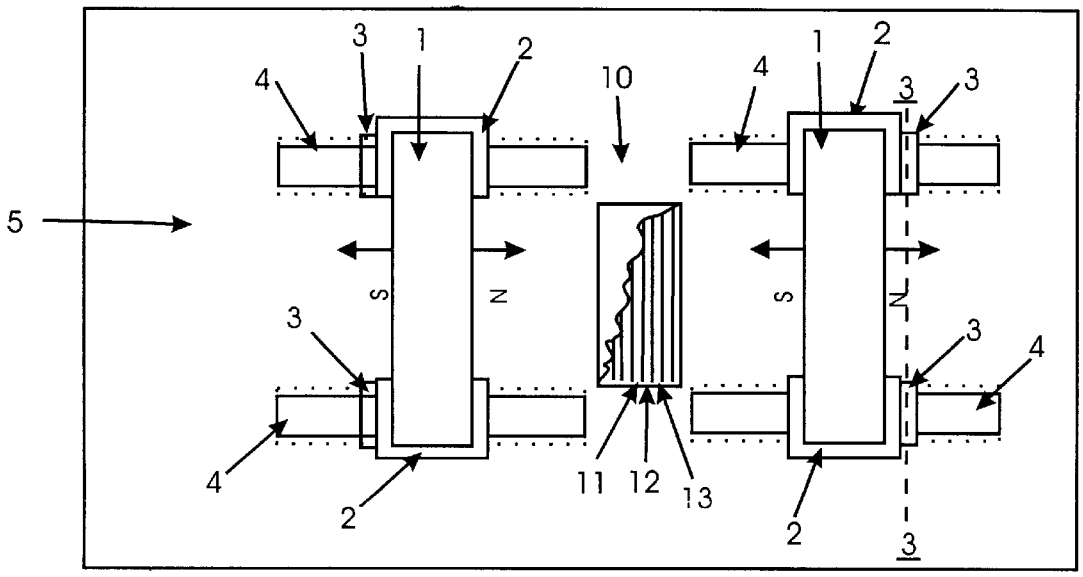
FIG. 1 is a top plan view of a product according to the invention.
Figure 2:
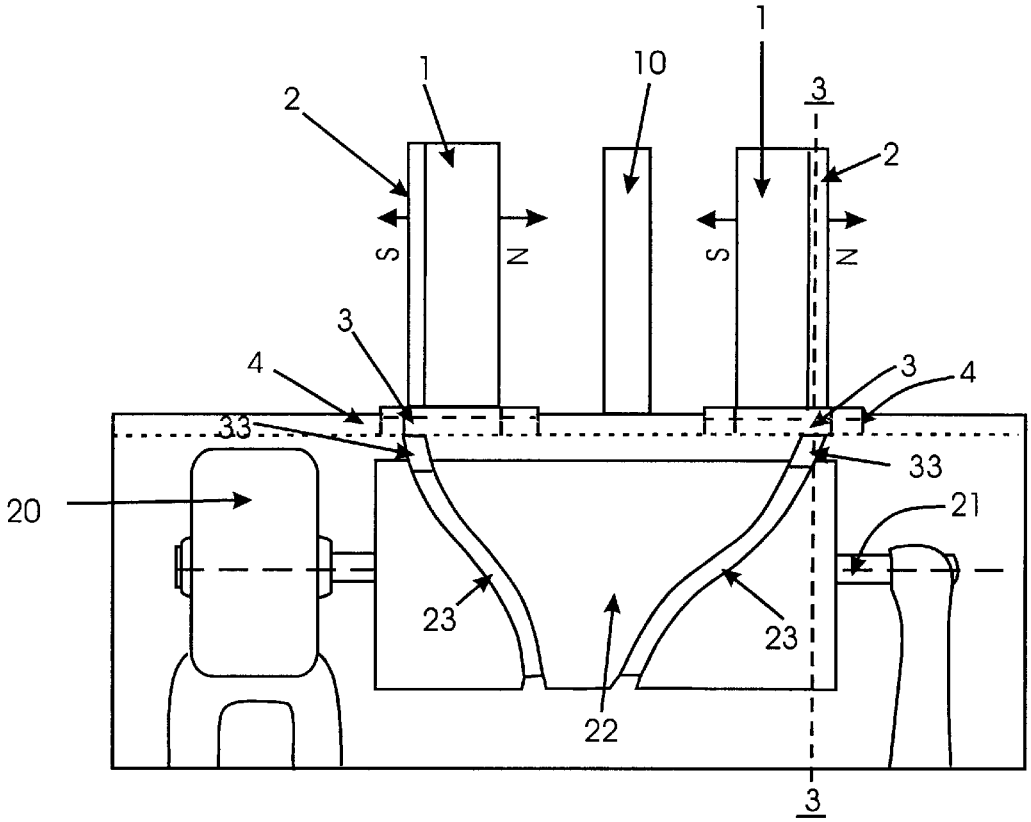
FIG. 2 is a view in elevation and partial section of the same product.
Figure 3:
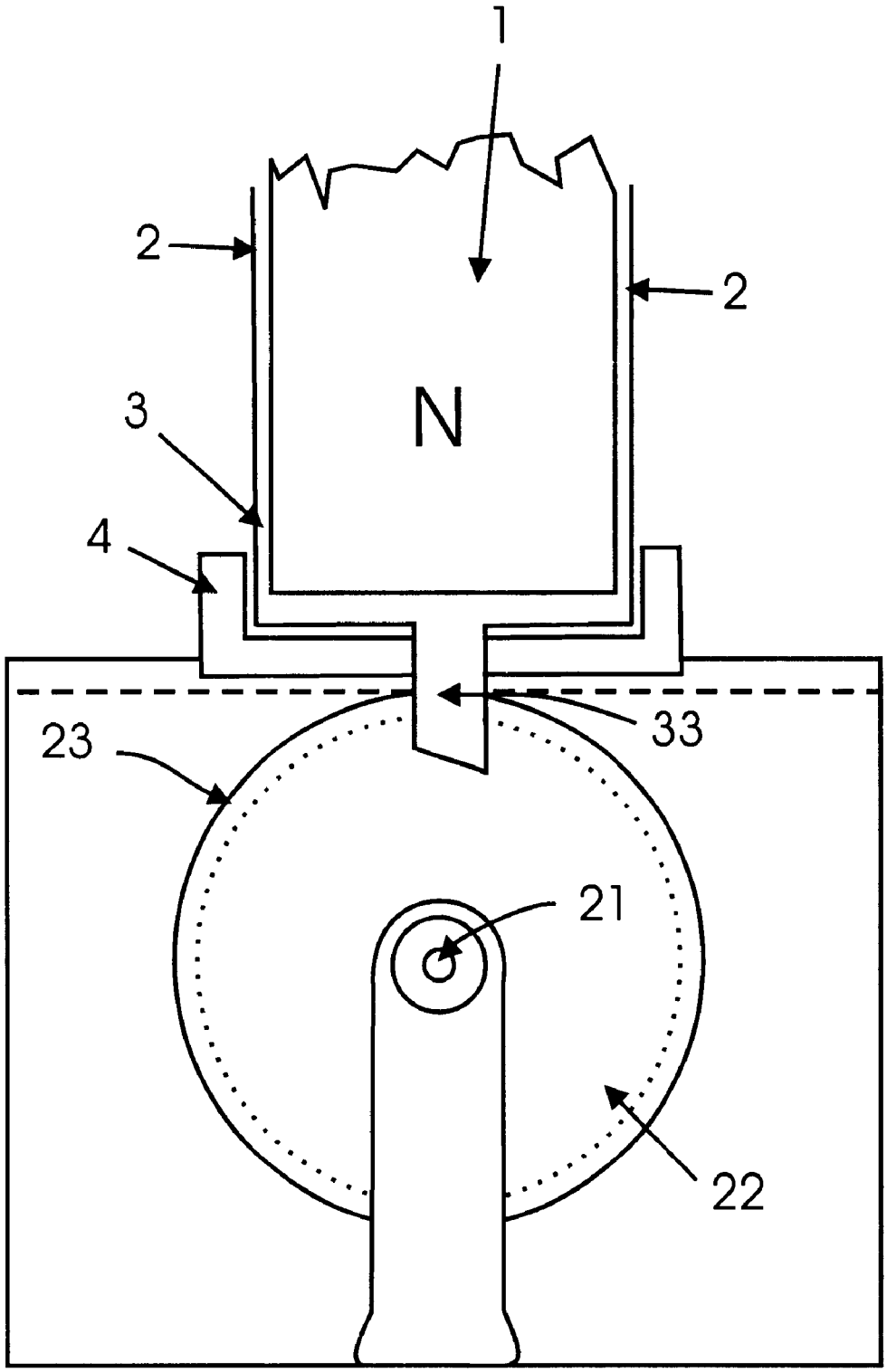
FIG. 3 is a sectional view facinq the plane indicated in both FIG. 1 and FIG. 2 by dashed line 3—3.

With reference to FIGS. 1–3 two permanent magnet assemblies 1 are held each between channels 2, with the lower portions of which sliding supports 3 are in rigid connection. Supports 3 slidably engage in guides 4 set into the top of casing 5. An article 10, partially cut away to show internally set parallel ferromagnetic plates 11 and 13 separated by non-magnetic separators 12, is secured in a position midway between magnets 1 by means not shown, eg., a removable clamp over the top of the article. Faces of magnets 1, as well as of plates 11 and 13, and separators 12, are all of congruent shape and similar size respecting one another.

Inward faces of the assemblies of magnets 1 must be of unlike magnetic polarity.

With reference to FIG. 2, below casing 5 there are shown: a motor 20, a driveshaft 21 projecting from motor 20, a cylindrical cam 22 secured to driveshaft 21, grooves 23 machined into cam 22, and followers 33 each extending downwardly from connection with a horizontal sliding support 3. Since the followers 33 fit slidably into grooves 23, when cam 22 rotates due to operation of motor 20 a motion of alternating inwardly/outwardly directed counter-vibration is imparted to the followers 33, hence to supports 3 and to permanent magnet assemblies 1. Preferably the grooves 23 are designed to provide both maximum inward acceleration just before reversal of direction of followers 33, and maximum mechanical advantage upon reversal to facilitate separation of magnet assemblies 1 on their outward motions.

Since the more powerful is attraction between the mutually facing magnets of counter-vibrated assemblies 1, the more work is required to increase their separation, the advantage of a specially designed cam for transmitting power in an appropriate manner from a constant torque, constant speed motor is apparent. Any type of motor or counter-vibrating motion actuator may be used, so long as about five counter-vibration cycles within a time-frame of a second can be enacted using it. Magnet assemblies 1 could conceivably be arranged spokelike on counter-rotating wheels with a gap therebetween (not shown), in which case, however, there would be a sine function concerning projected oscillation of central points of outward facing magnet faces, and also an uneven load resisting wheel rotation, the resistance increasing to a maximum at instants when the opposed magnet faces of the two wheels are closest together.

It may be noted that a more 'saw-toothed' like function pertaining to counter-vibrated magnet faces is obtainable using a cam, with more acceleration on approaching narrowest gap width, less on gap opening, which is considered desirable in accordance with a theory held by the inventor that a useful "magnetic hammering" effect is thereby optimized.

The magnets of assemblies 1 are preferably neodymium-iron-boron.

Figure 4:
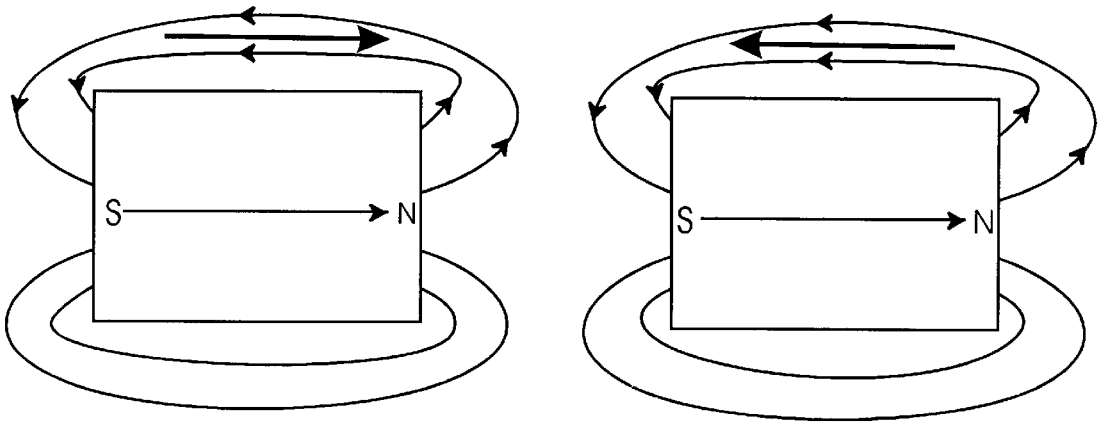
FIG. 4 is a schematic illustration showing flux line configuration when the gap between moving permanent magnet faces of unlike polarity is widest.
Figure 5:
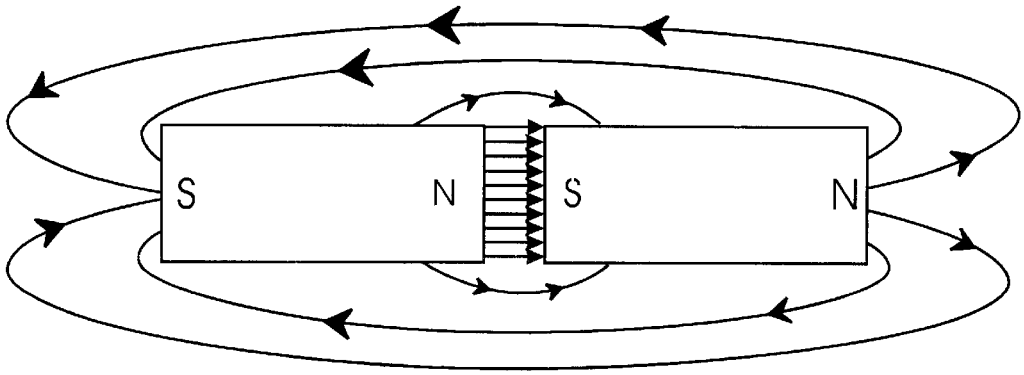
FIG. 5 is a similar illustration as FIG. 4 but with the gap at narrowest width.

FIGS. 4 and 5 show via conventional flux lines alternate configurations of magnetic fields about the counter-vibrated magnets 1 of any typical example of an embodiment of the invention, showing in FIG. 4 that the two fields are substantially independent when the gap is greatest between the magnets 1, and showing in FIG. 5 that flux between them converges in the yap when at its narrowest.

Article 10 in FIGS. 1–3 could be a single ferromagnetic plate instead of what is illustrated, and could also be otherwise shaped, for example, C-shaped instead of flat, in which case, however, the assemblies 1 should be configured similarly. Long articles, such as strips, can be continuously moved transversely through the magnetizing gap so long as the shape at any cross-section along the length is constant; otherwise an intermittent mode of operation would be necessary.

FIG. 6 graphs findings when testing an embodiment with a nickel-metal hydride multi-plate battery emplaced like article 10 in FIGS. 1–3, using about twenty counter-vibration cycles consisting of 5 cm. strokes bringing strong magnets to less than 1 mm. from the plastic case wall of the battery.

Three identical commercially available nickel-metal hydride battery units were obtained for testing, each individually cased and usable as a battery itself although for use in large traction battery banks such units may be connected in groups of ten.

After receiving 1.24 Ahr of charging at 15 amperes, one unit that never was treated in the kit discharged 0.74 Ahr through a resistor over five minutes. The two other units were subjected in the kit to magnetization in accordance with the mechanically pulsed magnetization method of the invention. After treatment their acceptance, in both cases, of charging current at 15 amperes was only 0.01 Ahr higher than for the untreated unit, there being insignificant difference respecting charge acceptance for the unit emplaced in one direction, compared to the unit emplaced in the other direction, end-for-end. Discharge over 5 minutes through the same resistor, gave for these same two units 0.94 and 0.58 Ahr.—remarkable considering that the sole difference in their treatment histories was end-for-end reversed emplacement.

Why the 0.36 Ahr discharging property difference caused by battery emplacement reversal in the kit occurs without corresponding similar magnitude of effect of emplacement reversal on charging is not understood.

The present invention, although of an unexpected nature, is easy to carry out as already described, and its utility extends beyond without excluding the making of a plate magnet with opposite poled faces thereon, insofar as a pre-existing type of battery normally typified as being of a given level drain type, eg., 'high drain', may by virtue of presence in the disclosed kit be rendered—for lack of a better term—a 'modifiably higher or lower drain' battery.

At the present time it is often necessary before processing through the kit a number of similar batteries of a known normal discharge property and known orientation of plates with respect to case sides, to conduct a simple emplacement effect test on one of the batteries, followed by a helpful marking expedient. A vertical stripe, in chalk, for example, is marked on the side arbitrarily chosen to face the N-poled facing magnet 1 during processing. After enacting the counter-vibration of magnets procedure, discharge the test battery with metering as in the above-described test. Then, if the drain rate has been elevated, head the top of the chalked stripe with an up-arrow. If the lower drain modification is instead achieved by the arbitrary one-of-two possible emplacement positions, then give the stripe an inverted arrowhead at the bottom. Then turn the battery around and mark the opposite side with an arrow-stripe inverted to the first-made mark.

Thereafter by matching external features of all the similarly fabricated batteries, it is predeterminably known by reference to the marked pre-tested battery which case side should face the N-pole for whichever of the two possible results—higher or lower drain—is sought in use of the kit.

On the topic of mass-processing, either to make magnets or modify battery properties, conveying means designable without need for inventive ingenuity may obviously be combined with the kit for either intermittent or continuous operation. The conveyor would run transversely through the gap between the two moving magnets 1 of unlike-poled inward faces. Viable conveying speeds can be found without undue experimentation, as can a large number of other elaborations on the basic illustrated embodiment.

It will be understood that the exact mechanical means for imparting the intended counter-vibration of magnetizing permanent magnets 1 may vary, scotch yokes, eccentrics, various wheels and linkages, or linear actuators, for example being in many instances usable in substitution for illustrated cam mechanism and cheaper to build. It is noteworthy, however, that unlike what has been taught respecting relative motion in the prior art, there is here no possible equivalent obtaining the same effect of moving the magnets by moving the article to be magnetized. The article must be between the magnetizinq magnets moved inwardly toward it and then outwardly from it, there being no way conceivable for causing a unitary and substantially rigid article to move in opposite directions at once towards and away from magnets bracketing the article from both sides.

Although the invention has been described with reference to a particular illustrated embodiment, it is not intended to be limited to the details shown, since a wide variety of modifications and structural changes may be made therein without departing from the spirit of the invention and while remaining within the scope and range of the following claims.

What is claimed is:

1. A product comprising in combination a pair of mechanically counter-vibrated permanent magnets having mutually facing unlike poles on congruently shaped faces of said magnets, and, positioned midway between said counter-vibrated magnets, an article intended to be subjected to at least five pulses per second of magnetizing flux between said counter-vibrated magnets, and selected from one of the following: a single piece of ferromagnetic material having two principal opposite faces, a congruent shape and similar facial surface areas as said magnets have; two or more similar ferromagnetic pieces separated by non-magnetic separators; and, a battery including multiple similar ferromagnetic electrodes.

2. A mechanically pulsed magnetization kit in accordance with claim 1, wherein said article positioned midway between said counter-vibrated permanent magnets is a multi-plate nickel-metal hydride battery.

3. A method of employing the product of claim 1 to alternatively modify the current drain property of a multi-plate nickel-metal hydride battery that when unmodified discharges at about 0.74 Ahr. for a five minute discharge through a given resistor, either to about a 0.20 Ahr. higher discharge rate or else to about a 0.16 Ahr. lower discharge rate, in both instances for five minute discharges through said same given resistor, wherein the method consists of emplacing said battery in that one of two possible end-for-end orientations midway between said counter-vibrated magnets which has been predetermined by testing to have the intended modifying result, and then subjecting said emplaced battery for four seconds to pulsed magnetic flux effects of enacting counter-vibration of said magnets at five cycles per second, wherein the closest approach to oppositely facing ends of said battery of each of said mutually facing faces of said magnets bearing unlike magnetic poles thereon is about 1 mm. and said same faces of said magnets are each withdrawn to about 5 cm. from said battery ends at the outermost positions of said counter-vibrated magnets.

* * * * *